US011413484B2

(12) United States Patent
Norris et al.

(10) Patent No.: US 11,413,484 B2
(45) Date of Patent: Aug. 16, 2022

(54) FIRE SUPPRESSION SYSTEM FOR AIRCRAFT

(71) Applicant: Kidde Technologies, Inc., Wilson, NC (US)

(72) Inventors: Robert J. Norris, Zebulon, NC (US); Tadd F. Herron, Chocowinity, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 418 days.

(21) Appl. No.: 16/518,935

(22) Filed: Jul. 22, 2019

(65) Prior Publication Data

US 2021/0023407 A1 Jan. 28, 2021

(51) Int. Cl.

| | |
|---|---|
| ***A62C 35/68*** | (2006.01) |
| ***A62C 3/08*** | (2006.01) |
| ***A62C 35/64*** | (2006.01) |
| ***A62C 37/50*** | (2006.01) |

(52) U.S. Cl.

CPC ..... *A62C 35/68* (2013.01); *A62C 3/08* (2013.01); *A62C 35/64* (2013.01); *A62C 37/50* (2013.01); *F17C 2250/0434* (2013.01); *F17C 2250/0439* (2013.01)

(58) Field of Classification Search

CPC ..... A62C 35/68; A62C 3/08; A62C 35/64; A62C 37/50; F17C 2250/0434; F17C 2250/0439

USPC ..... 73/1.35

See application file for complete search history.

(56) References Cited

U.S. PATENT DOCUMENTS 5,578,993 A * 11/1996 Sitabkhan ..... A62C 37/50 340/592
9,971,366 B2 5/2018 Thogersen et al.
10,352,801 B2 7/2019 Stilwell et al.

FOREIGN PATENT DOCUMENTS

EP 2759823 A2 7/2014

OTHER PUBLICATIONS

European Search Report; Application No. 19212818.9-1113; dated Jul. 3, 2020; 9 pages.

* cited by examiner

*Primary Examiner* — Mary E McManmon
*Assistant Examiner* — Christopher M Afful
(74) *Attorney, Agent, or Firm* — Cantor Colburn LLP

(57) ABSTRACT

Disclosed is a method of monitoring pressure in a fire suppression system of an aircraft, the method providing: receiving a first pressure-vessel measured pressure from a first pressure-vessel pressure transducer connected to a first pressure-vessel; receiving a second pressure-vessel measured temperature from a second pressure-vessel temperature sensor connected to a second pressure-vessel; calculating a first pressure-vessel estimated pressure from the second pressure-vessel measured temperature; comparing the first pressure-vessel measured pressure With the first pressure-vessel estimated pressure; and providing a depressurization alert when a difference between the first pressure-vessel measured pressure and the first pressure-vessel estimated pressure is greater than a threshold thereby avoiding unscheduled aircraft downtime due to an erroneous or missing temperature measurement in the first pressure-vessel.

20 Claims, 5 Drawing Sheets

FIRE SUPPRESSION SYSTEM FOR AIRCRAFT

BACKGROUND

The disclosed embodiments are directed to a fire suppression system for an aircraft and more specifically to a fire suppression system that monitors for depressurization in one pressure-vessel of the fire suppression system by monitoring temperatures in other pressure-vessels of the fire suppression system.

An aircraft may contain a fire suppression system that may include pressure-vessels that contain pressurized fire suppressant and are located in clusters in a wheel well, cargo hold, engine nacelle, wing root, etc. The pressure-vessels may be stored for long periods of time during which seals may be subject to degradation, causing depressurization. A fire suppression system on board an aircraft should be maintained in a ready condition so that the system may function optimally in the event of an emergency.

SUMMARY OF THE EMBODIMENTS

Disclosed is a method of monitoring pressure in a fire suppression system of an aircraft, comprising: receiving a first pressure-vessel measured pressure from a first pressure-vessel pressure transducer connected to a first pressure-vessel; receiving a second pressure-vessel measured temperature from a second pressure-vessel temperature sensor connected to a second pressure-vessel; calculating a first pressure-vessel estimated pressure from the second pressure-vessel measured temperature; comparing the first pressure-vessel measured pressure with the first pressure-vessel estimated pressure; and providing a depressurization alert when a difference between the first pressure-vessel measured pressure and the first pressure-vessel estimated pressure is greater than a threshold, thereby avoiding unscheduled aircraft downtime due to an erroneous or missing temperature measurement in the first pressure-vessel.

In addition to one or more of the above disclosed features, or as an alternate the method further comprises determining that a first pressure-vessel temperature sensor is malfunctioning before estimating pressure for the first pressure-vessel from the second pressure-vessel measured temperature.

In addition to One or more of the above disclosed features, or as an alternate the method further comprises determining that the first pressure-vessel temperature sensor is malfunctioning when the first pressure-vessel temperature sensor is fading to provide a first pressure-vessel measured temperature.

In addition to one or more of the above disclosed features or as an alternate the method further comprises receiving a first pressure-vessel measured temperature from the first pressure-vessel temperature sensor; receiving a third pressure-vessel measured temperature from a third pressure-vessel temperature sensor connected to a third pressure-vessel; comparing the first pressure-vessel measured temperature, the second pressure-vessel measured temperature and the third pressure-vessel measured temperature and determining therefrom that the first pressure-vessel pressure transducer is malfunctioning.

In addition to one or more of the above disclosed features, or as an alternate the method further comprises determining that: a first difference between the first pressure-vessel measured temperature and the second pressure-vessel measured temperature is greater than the threshold; and a second difference between the second pressure-vessel measured temperature and the third pressure-vessel measured temperature is less than the threshold; thereby determining that that the first pressure-vessel temperature sensor is malfunctioning.

In addition to one or more of the above disclosed features, or as an alternate the method further comprises providing a maintenance alert when the first pressure-vessel temperature sensor is malfunctioning.

Further disclosed is a method of monitoring pressure in fire suppression system of an aircraft, comprising: receiving a plurality of pressure-vessel measured temperatures from a respective plurality of pressure-vessel temperature sensors operationally connected to a respective plurality of pressure-vessels; determining an operational state of a first pressure-vessel temperature sensor of the plurality of pressure-vessel temperature sensors, operationally connected to a first pressure-vessel of the plurality of pressure-vessels, by comparing the plurality of pressure-vessel measured temperatures with one another; calculating a first pressure-vessel estimated pressure for the first pressure-vessel from a second pressure-vessel measured temperature of the plurality of pressure-vessel measured temperatures when the first pressure-vessel temperature sensor is malfunctioning; and providing a depressurization alert when a difference between a first pressure-vessel measured pressure and the first pressure-vessel estimated pressure is greater than a threshold, thereby avoiding unscheduled aircraft downtime due to an erroneous or missing temperature measurement in the first pressure-vessel.

Further disclosed is a fire suppression system of an aircraft comprising: a first pressure-vessel having a first pressure-vessel pressure transducer; a second pressure-vessel having a second pressure-vessel temperature sensor; a controller operationally connected to the first pressure-vessel pressure transducer and the second pressure-vessel temperature sensor, the controller configured to: receive a first pressure-vessel measured pressure from the first pressure-vessel pressure transducer; receive a second pressure-vessel measured temperature from the second pressure-vessel temperature sensor; calculate a first pressure-vessel estimated pressure from the second pressure-vessel measured temperature; compare the first pressure-vessel estimated pressure with the first pressure-vessel measured pressure; and provide a depressurization alert when a difference between the first pressure-vessel measured pressure and the first pressure-vessel estimated pressure is greater than a threshold, thereby avoiding unscheduled aircraft downtime due to an erroneous or missing temperature measurement in the first pressure-vessel.

In addition to one or more of the above disclosed features, or as an alternate the system further comprises a first pressure-vessel temperature sensor operationally connected to the controller, and wherein the controller is configured to determining that the first pressure-vessel temperature sensor is malfunctioning before estimating pressure for the first pressure-vessel from the second pressure-vessel measured temperature.

In addition to one or more of the above disclosed features, or as an alternate the controller is further configured to determine that the first pressure-vessel temperature sensor is malfunctioning when the first pressure-vessel temperature sensor is fading to provide a first pressure-vessel measured temperature.

In addition to one or more of the above disclosed features, or as an alternate the system further comprises a third pressure-vessel with a third pressure-vessel temperature sensor operationally connected to the controller, and wherein the controller is configured to: receive the first pressure-vessel measured temperature from the first pressure-vessel temperature sensor; receive a third pressure-vessel measured temperature from the third pressure-vessel temperature sensor; compare the first pressure-vessel measured temperature, the second pressure-vessel measured temperature and the third pressure-vessel measured temperature and determine therefrom that the first pressure-vessel pressure transducer is malfunctioning.

In addition to one or more of the above disclosed features, or as an alternate the controller further determines that: a first difference between the first pressure-vessel measured temperature and the second pressure-vessel measured temperature is greater than the threshold; and a second difference between the second pressure-vessel measured temperature and the third pressure-vessel measured temperature is less than the threshold; thereby determining that that the first pressure-vessel temperature sensor is malfunctioning.

In addition to one or more of the above disclosed features, or as an alternate the controller is further configured to provide a maintenance alert when the first pressure-vessel temperature sensor is malfunctioning.

In addition to one or more of the above disclosed features, or as an alternate the second pressure-vessel further includes a second pressure-vessel pressure transducer operationally connected to the controller and the third pressure-vessel includes a third pressure-vessel pressure transducer operationally connected to the controller.

Further disclosed is an aircraft including a cargo bay and the fire suppression system disclosed herein.

In addition to one or more of the above disclosed features, or as an alternate the aircraft further comprises a discharge head; and a piping system connecting the first pressure-vessel, the second pressure-vessel and the third pressure-vessel with the discharge head.

In addition to one or more of the above disclosed features, or as an alternate each pressure-vessel pressure transducer and each pressure-vessel temperature sensor communicates with the controller over a common databus.

In addition to one or more of the above disclosed features, or as an alternate each pressure-vessel pressure transducer and each pressure-vessel temperature sensor on each pressure-vessel communicates with the controller on one of a respective plurality of databuses.

In addition to one or more of the above disclosed features, or as an alternate the controller is configured to communicate a maintenance alert and the depressurization alert to electronics in a cockpit.

In addition to one or more of the above disclosed features, or as an alternate the controller communicates with the pressure-vessels over a wireless network.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
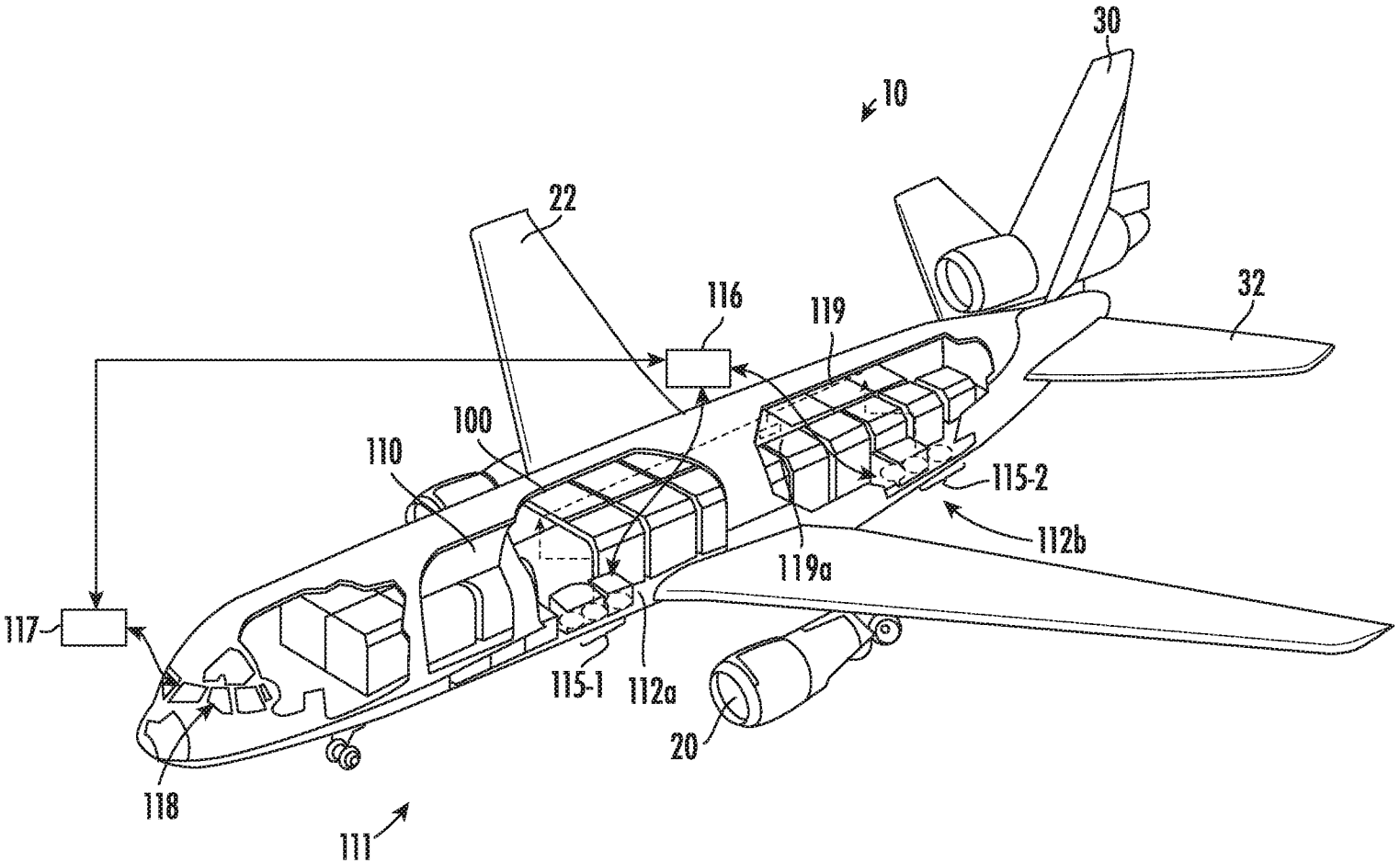
FIG. 1 is a perspective view of an aircraft which may include a fire suppression system according to an embodiment.

FIG. 1 illustrates an example of an aircraft 10. The aircraft 10 includes two wings 22, a horizontal stabilizer 32 and vertical stabilizer 30. The aircraft 10 includes a cargo bay 110. The aircraft incudes aircraft engines on the two wings 22 or other locations surrounded by (or otherwise carried in) respective nacelles 20. In one embodiment the aircraft 10 is a commercial aircraft.

The aircraft 10 includes a fire suppression system 111 that may be used to control a fire threat. The fire suppression system 111 includes a plurality of pressure-vessels 115, including a first set of pressure-vessels 115-1 and a second set of pressure-vessels 115-2, illustrated schematically in FIG. 1. The plurality of pressure-vessels 115 may be located in respective cargo areas 112, including a first cargo area 112*a* and a second cargo area 112*b*, sometimes referred to as "cheeks", adjacent to the cargo bay 110 on wide body and single aisle aircraft. Within some aircraft, the pressure-vessels 115 may be installed in different locations. Pressure-vessels 115 installed near each other in a same area are typically exposed to a relatively same air temperature around each of the pressure-vessels 11. In some configurations, pressure-vessels 115 are installed in aircraft pylons (e.g., in pairs of pressure-vessels 115). In some configurations, engine or cargo pressure-vessels 115 are installed in wing fairings or aft equipment bays. In such configurations, pressure-vessels 115 may not be expected to be exposed to a same temperature as if the pressure-vessels 115 were located in cargo bays.

The plurality of pressure-vessels 115 may be sealed and pressurized with fire suppressant agents to suppress cargo bay fires as well as engine fires.

The fire suppression system 111 may include a controller 116 that communicates pertinent information, such as alerts, to suitable electronics 117 in the cockpit 118. The controller 116 may control operation of the pressure-vessels 115 to deliver fire suppressant upon detecting a fire, for example, in the cargo bay 110. The fire suppressant is delivered by a fluid delivery system such as a piping system 119 (illustrated schematically), which may include a nozzle 119*a* (illustrated schematically).

There is a need to verify accurate pressures of the pressure-vessels 115 on the aircraft 10 during flight operations. In one embodiment, pressure is measured as well as being estimated from measured temperatures, and the values may be compared to redundantly ensure that the pressure within the pressure-vessels 11 remains within acceptable limits. Immediate, typically unscheduled replacement of the pressure-vessels 11 may be required if a pressurized state of the pressure-vessels 11 cannot be determined, disrupting flights and raising airline costs.

Figure 2:
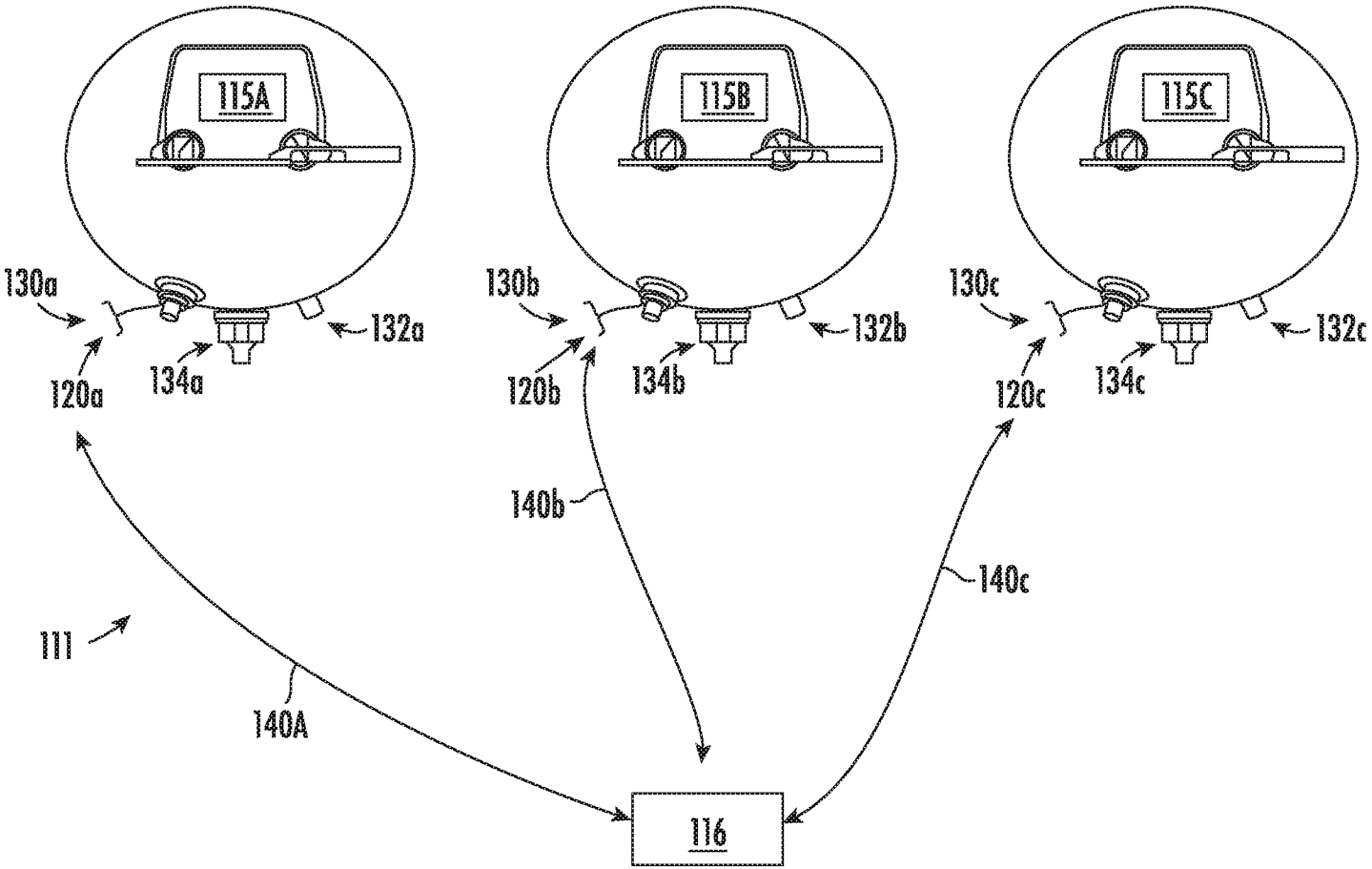
FIG. 2 illustrates pressure-vessels of the fire suppression system of FIG. 1.

Turning to FIG. 2, the plurality of pressure-vessels 115 are illustrated including a first pressure-vessel 115*a*, a second pressure-vessel 115*b* and a third pressure-vessel 115*c*. It is to be appreciated that the disclosed embodiments are not limited three pressure-vessels 115. The pressure-vessels 115 may be high rate discharge vessels, low rate discharge vessels, or one or more of each, typically used in such fire suppression system 111. The plurality of pressure-vessels 115 are operationally connected to the controller 116 for the fire suppression system 111. The pressure-vessels 115 may be dynamically monitored to confirm there is no unexpected depressurization, for example, due to a seal failure in any one of the pressure-vessels 11.

Within each of the storage areas 112 for the pressure-vessels 115, the temperature should be similar between all installed pressure-vessels 115. Therefore, the temperature within each of the storage areas 112 for the pressure vessels 115 should also be the temperature of each of the pressure-vessels 115 under near steady state conditions. There may be large differences in air temperature between the cargo bay and the storage area for the pressure vessels 115. There may be a relatively large thermal lag between the extinguishing agent within a pressure vessel 115 and a surrounding air temperature due to the thermal mass of the extinguishing agent. At cruise conditions for an aircraft, air temperature changes will be small and roughly steady state. Thus, during flight, a temperature in the pressure vessels 115 becomes that of the surrounding air temperature. Due to the relationship between temperature and pressure, it is possible to accurately estimate the expected pressure using the measured temperature.

In addition, the pressure of the pressure-vessels 115 may be measured and the value may be compared to redundantly check the whether the pressure-vessels 115 are depressurizing.

To measure pressure and temperature, the plurality of pressure-vessels 115 include a respective plurality of pressure-vessel pressure transducers 120 and a respective plurality of pressure-vessel temperature sensors 130. Each of the pressure-vessel pressure transducers 120 and the pressure-vessel temperature sensors 130 may be operationally connected to the controller 116. Such a connection can be wireless or via one or more databuses 140. For example, the databuses 140 may comprise a common databus shared among the pressure-vessels 115 or there may be a plurality of databuses 140, such as first databus 140*a*, second databus 140*b*, and third databus 140*c*, extending between the controller 116 and each of the respective pressure-vessels 115. Each of the pressure-vessels 115 may thus report temperatures and pressures over the different databuses 140 with the results collected by the controller 116.

As illustrated, the first pressure-vessel 115*a* includes a first pressure-vessel pressure transducer 120*a* and a first pressure-vessel temperature sensor 130*a*. The first pressure-vessel 115*a* further includes a first fill port 132*a* and a first discharge port 131*a*. The second pressure-vessel 115*b* includes a second pressure-vessel pressure transducer 120*b* and a second pressure-vessel temperature sensor 130*b*. The second pressure-vessel 115*b* further includes a second fill port 132*b* and a second discharge port 134. The third pressure-vessel 115*c* includes a third pressure-vessel pressure transducer 120*c* and a third pressure-vessel temperature sensor 130*c*. The third pressure-vessel 115*c* further includes a third fill port 132*c* and a third discharge port 134*c*. The number and location of fill and discharge ports are not limited to those shown in the figures. The pressure-vessel pressure transducers 120 and the pressure-vessel temperature sensors 130 are solid-state transducers in one embodiment. Mechanical transducers (not illustrated) include mechanical parts which may fail. Mechanical transducers, when malfunctioning, may inadvertently issue a warning signal indicating a no-go condition has been reached, resulting in an Aircraft-On-Ground (AOG) condition. An AOG condition may require that the aircraft remain on ground until the fire extinguisher vessel is replaced. Mechanical transducers may also fail to issue a warning signal when the pressure is below its allowed limit creating a latent failure condition which would not lead to the necessary maintenance action. In addition, aged mechanical transducers may require periodic replacement and servicing, which may be expensive and time consuming. Solid-state transducers, in comparison, have few moving parts and are compact. Thus, the solid-state transducers can be packaged to fit a variety of receptacles, including pressure-vessels, valves, other ports, etc. where mounting room is at a minimum.

As can be appreciated, if the first pressure-vessel temperature sensor 130*a* malfunctions, it may fail to provide a temperature reading or may provide a faulty reading. If a faulty reading is provided, an estimated pressure in the first pressure-vessel 115*a* may not match the measured pressure within the first pressure-vessel 115*a*. This may result be a faulty determination that the first pressure-vessel 115*a* has depressurized, for example due to a seal failure. Such determination, though unrelated to an actual depressurization in the first pressure-vessel 115*a*, may result in an unscheduled replacement of the first pressure-vessel 115*a*, disrupting flights and raising airline costs. However, as indicated, each of the pressure-vessels 115 in each of the storage areas 112 for the pressure vessels 115 should have the same temperature within an allowed tolerance. Thus, a measured temperature from the second pressure-vessel temperature sensor 130*b* may be utilized to estimate pressure for the first pressure-vessel 115*a*. Thus, a fault in the first pressure-vessel temperature sensor 130*a* may be tolerated without having to immediately replace the first pressure-vessel 115*a* in order to maintain safe flight conditions.

Figure 3:
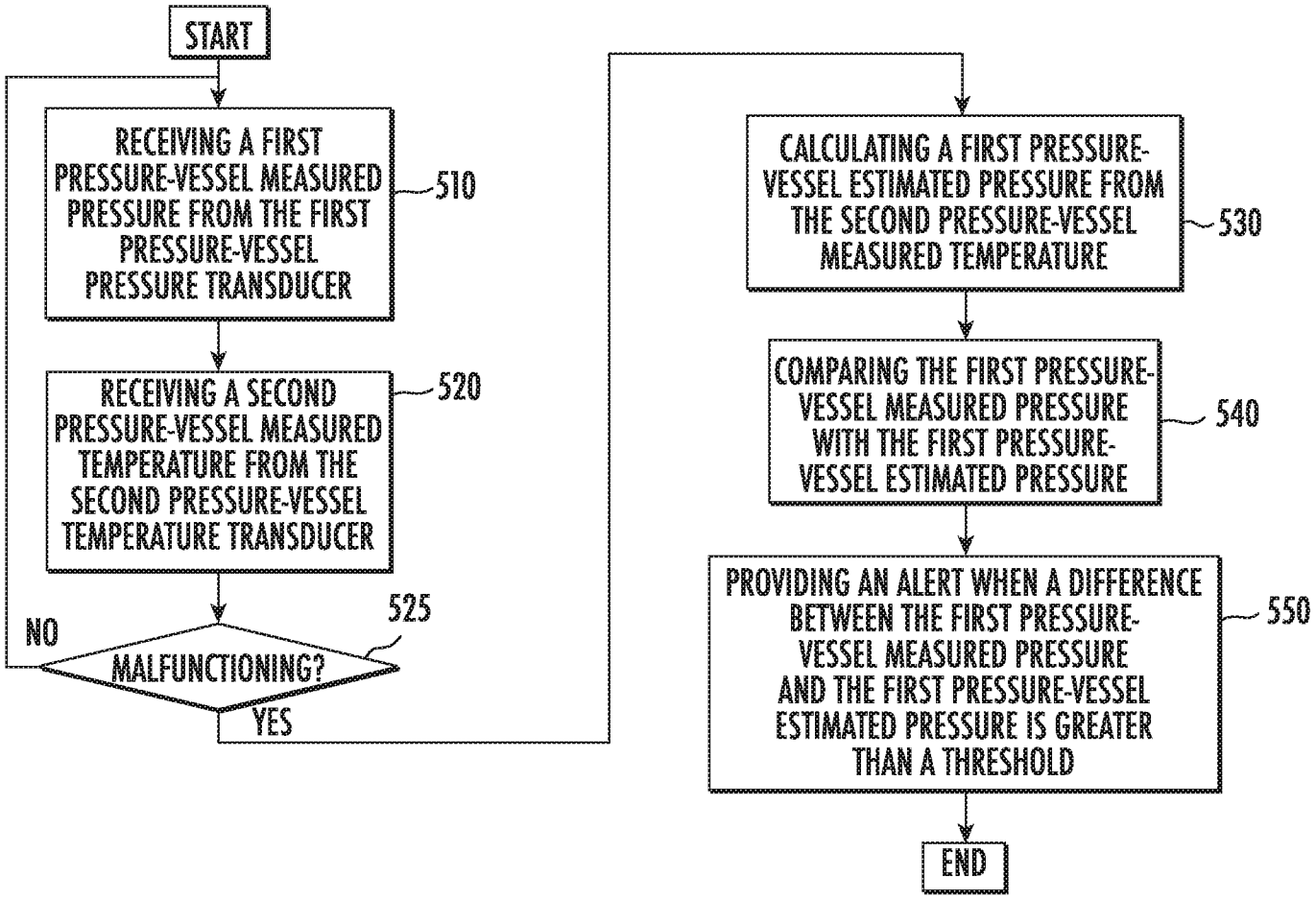
FIG. 3 is a flow chart illustrating a method of monitoring for depressurization of the pressure-vessels of FIG. 2 according to an embodiment.

Turning to FIG. 3, a method of monitoring pressure in the fire suppression system 111 of the aircraft 10 is illustrated. As shown at block 510 the method includes receiving a first pressure-vessel measured pressure from the first pressure-vessel pressure transducer 120*a*. At block 520, the method includes receiving a second pressure-vessel measured temperature from the second pressure-vessel temperature sensor 130*b*.

In one embodiment, as shown in block 525, the method includes determining whether the first pressure-vessel temperature sensor 130*a* is malfunctioning. Examples of how this determination is made and sub-processes that may occurring during such a determination are shown below (FIG. 3). If there is no malfunction (NO at block 525), then the process starts over, is illustrated in block 510, i.e., to monitor for system health by continuing to receive pressure readings. If there is a malfunction (YES at block 525), as illustrated at block 530, the method includes calculating a first pressure-vessel estimated pressure from the second pressure-vessel measured temperature. At block 540 the method includes comparing the first pressure-vessel measured pressure with the first pressure-vessel estimated pressure. At block 550 the method includes providing an alert when a difference between the first pressure-vessel measured pressure and the first pressure-vessel estimated pressure is greater than a threshold. The threshold value may be set for a given set of pressure-vessels 115 in a fire suppression system 111. The method steps identified above, and below herein unless otherwise identified, may be performed by the controller 116 communicating over the databuses 140 with the pressure-vessels 115 located in each of the cargo areas 112 of the cargo bay 110.

Figure 4:
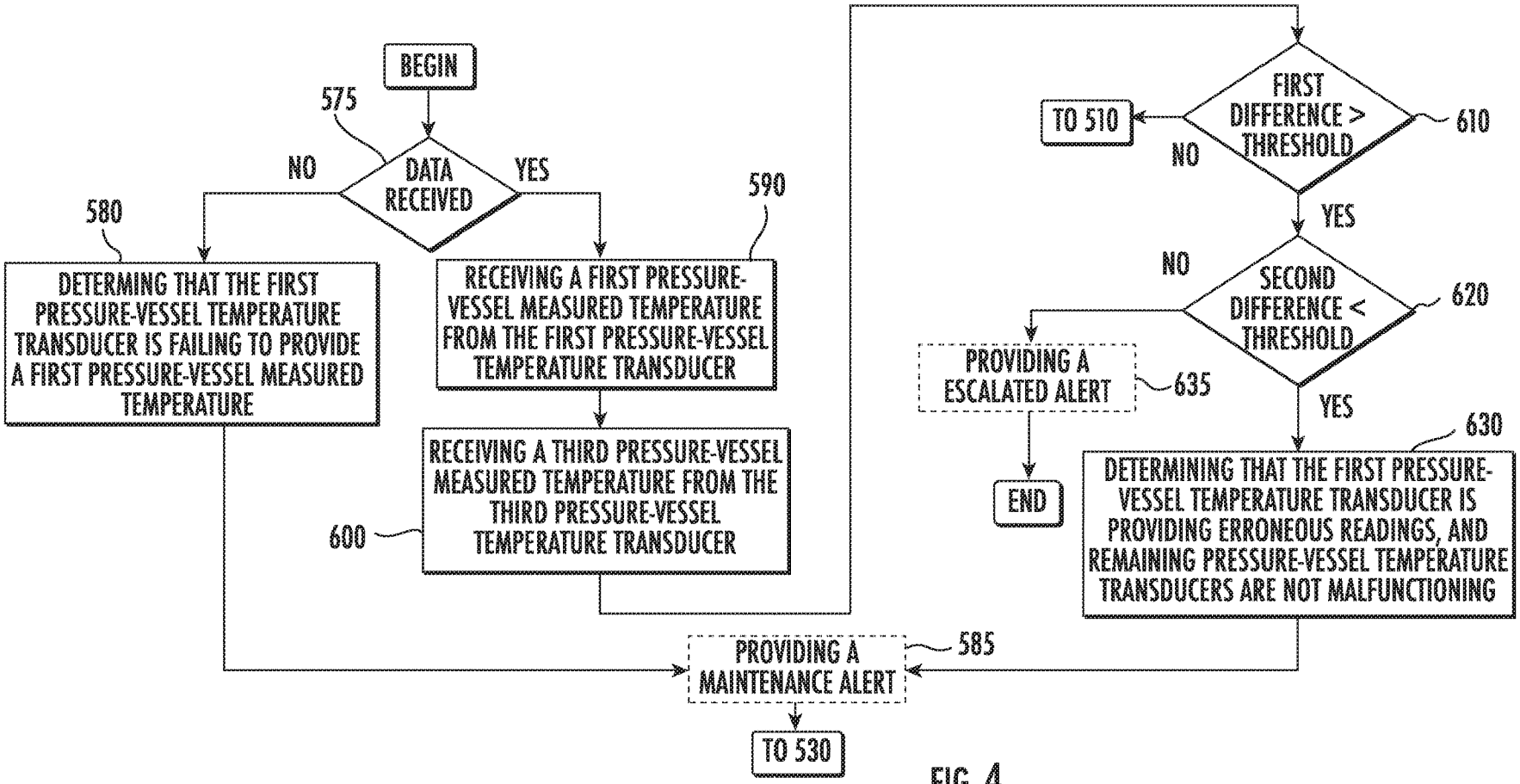
FIG. 4 is a flow chart further illustrating a portion the method of monitoring for depressurization of the pressure-vessels as shown in FIG. 3.

Turning to FIG. 4, a flowchart illustrates sub-process performed for rendering the determination at block 525 (FIG. 3) that the first pressure-vessel temperature sensor 130*a* is malfunctioning. Block 575 illustrates that a decision is made as to whether data is received. If no data is received (NO at block 575) then as illustrated in block 580, the method includes determining that the first pressure-vessel temperature sensor 130*a* is failing to provide a first pressure-vessel measured temperature. This may occur if the first pressure-vessel temperature sensor 130*a* is fully non-operable, inaccurate, and/or incapable of communicating with the controller 116. As illustrated at block 585, the method may include providing maintenance alert. The maintenance alert may be communicated to the cockpit electronics so that personnel may take appropriate action. Then process continues as illustrated in block 530 (FIG. 3).

If data is received (YES at block 575) then as illustrated in block 590 the method includes receiving a first pressure-vessel measured temperature from the first pressure-vessel temperature sensor 130*a*. As shown in block 600, the method includes receiving a third pressure-vessel measured temperature from the third pressure-vessel temperature sensor 130*c*.

Next, a comparison is made between the first pressure-vessel measured temperature, the second pressure-vessel measured temperature and the third pressure-vessel measured temperature. From the comparison, the controller 116 may determine that the first pressure-vessel temperature sensor 130*a* is malfunctioning. More specifically, block 610 illustrates that the method includes calculating a first difference between the first pressure-vessel measured temperature and the second pressure-vessel measured temperature or the third pressure-vessel measured temperature (or both).

If the first difference is not greater than a threshold (NO at block 610), then there is no malfunction and the process starts over, is illustrated in block 510, i.e., to monitor for system health by continuing to receive pressure readings. If the first difference is greater than the threshold (YES at block 610), then block 620 illustrates that a second difference is calculated between the second pressure-vessel measured temperature and the third pressure-vessel measured temperature. If this second difference is less than a threshold (YES at block 620) then as illustrated in block 630 a determination is made that (1) the first pressure-vessel temperature sensor 130*a* is malfunction by providing erroneous readings, and (2) the remaining plurality of pressure-vessel temperature sensors 130 are functioning properly. That is, if the majority of pressure-vessel temperature sensors 130 are aligned with their respective temperature readings, then the majority is deemed not malfunctioning, and the outlier pressure-vessel temperature sensor(s) is (are) malfunctioning. As indicated, the threshold values may be set for a given set of pressure-vessels 115 in a fire suppression system 111.

After the determination at block 630, the process may include providing the maintenance alert as illustrated in block 585, and then the process will continue as illustrated in block 530 FIG. 3). If, however, the second difference was not less than the threshold (NO at block 620) then there may be multiple system failures and an escalated alert may be provided as illustrated in block 635.

Figure 5:
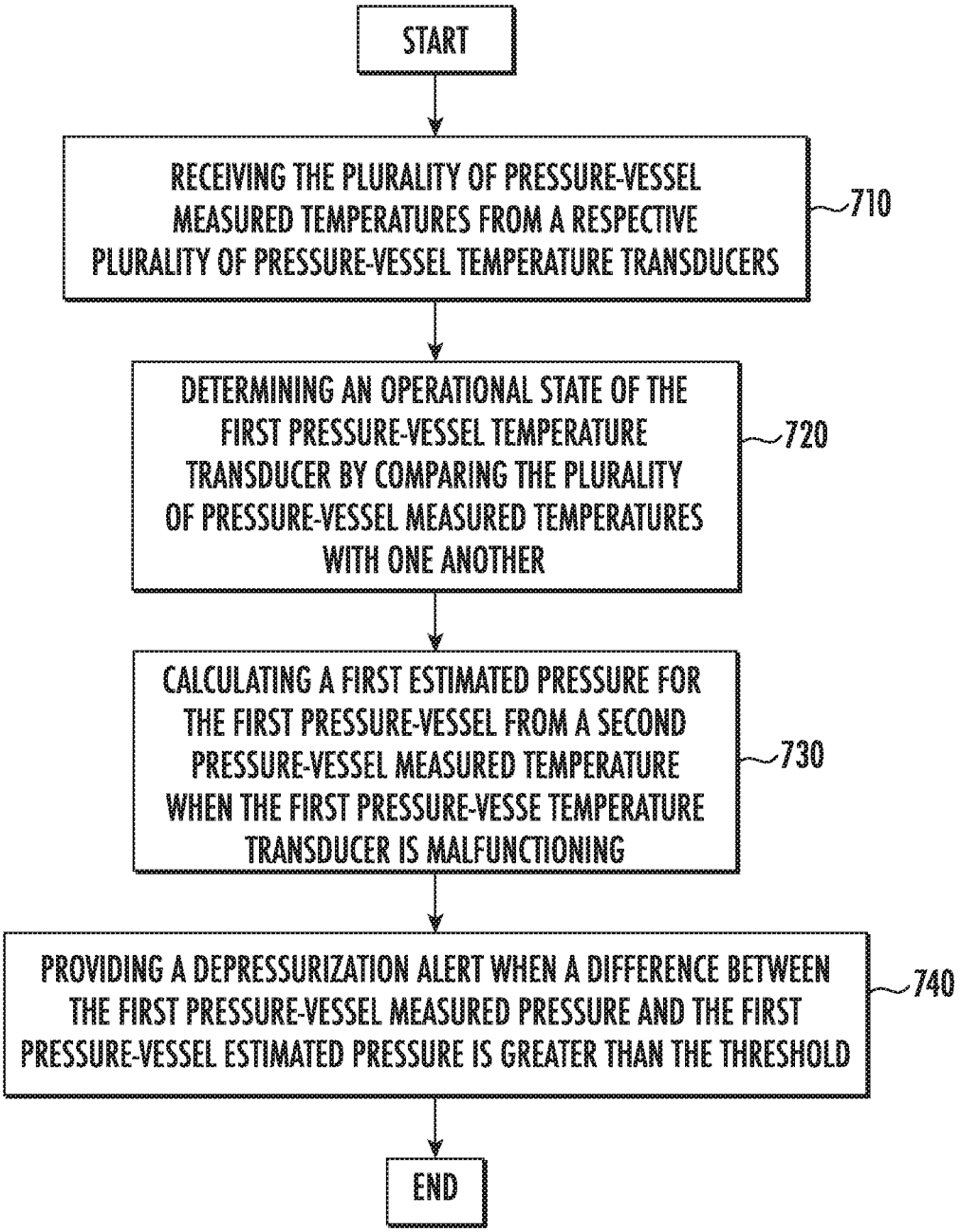
FIG. 5 is a flow chart that further illustrates a method of monitoring for depressurization of the pressure-vessels of FIG. 2 according to an embodiment.

In one embodiment, illustrated in FIG. 5, block 710 shows that the method of monitoring pressure in the fire suppression system 111 of the aircraft 10 includes receiving a plurality of pressure-vessel measured temperatures from the respective plurality of pressure-vessel temperature sensors 130. Block 720 illustrates that the method includes determining an operational state of the first pressure-vessel temperature sensor 130*a* by comparing the plurality of pressure-vessel measured temperatures with one another. Block 730 illustrates that the method includes calculating a first pressure-vessel estimated pressure for the first pressure-vessel 115*a* from the second pressure-vessel measured temperature when the first pressure-vessel temperature sensor 130*a* is malfunctioning. Block 740 illustrates that the method includes providing a depressurization alert when a difference between the first pressure-vessel measured pressure and the first pressure-vessel estimated pressure is greater than the threshold. The disclosed methods and systems, as indicated above, avoid unscheduled aircraft downtime due to an erroneous or missing temperature measurement in the first pressure-vessel.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof. Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method of monitoring pressure in a fire suppression system of an aircraft, comprising:

receiving a first pressure-vessel measured pressure from a first pressure-vessel pressure transducer connected to a first pressure-vessel;

receiving a second pressure-vessel measured temperature from a second pressure-vessel temperature sensor connected to a second pressure-vessel;

calculating a first pressure-vessel estimated pressure from the second pressure-vessel measured temperature;

comparing the first pressure-vessel measured pressure with the first pressure-vessel estimated pressure; and providing a depressurization alert when a difference between the first pressure-vessel measured pressure and the first pressure-vessel estimated pressure is greater than a threshold, thereby avoiding unscheduled aircraft downtime due to an erroneous or missing temperature measurement in the first pressure-vessel.

2. The method of claim 1, further comprising determining that a first pressure-vessel temperature sensor is malfunctioning before estimating pressure for the first pressure-vessel from the second pressure-vessel measured temperature.

3. The method of claim 2, further comprising determining that the first pressure-vessel temperature sensor is malfunctioning when the first pressure-vessel temperature sensor is failing to provide a first pressure-vessel measured temperature.

4. The method of claim 2, further comprising:

receiving a first pressure-vessel measured temperature from the first pressure-vessel temperature sensor;

receiving a third pressure-vessel measured temperature from a third pressure-vessel temperature sensor connected to a third pressure-vessel;

comparing the first pressure-vessel measured temperature, the second pressure-vessel measured temperature and the third pressure-vessel measured temperature and determining therefrom that the first pressure-vessel pressure transducer is malfunctioning.

5. The method of claim 4, further comparing includes determining that:

a first difference between the first pressure-vessel measured temperature and the second pressure-vessel measured temperature is greater than the threshold; and a second difference between the second pressure-vessel measured temperature and the third pressure-vessel measured temperature is less than the threshold;

thereby determining that that the first pressure-vessel temperature sensor is malfunctioning.

6. The method of claim 2, further comprising providing a maintenance alert when the first pressure-vessel temperature sensor is malfunctioning.

7. A method of monitoring pressure in fire suppression system of an aircraft, comprising:

receiving a plurality of pressure-vessel measured temperatures from a respective plurality of pressure-vessel temperature sensors operationally connected to a respective plurality of pressure-vessels;

determining an operational state of a first pressure-vessel temperature sensor of the plurality of pressure-vessel temperature sensors, operationally connected to a first pressure-vessel of the plurality of pressure-vessels, by comparing the plurality of pressure-vessel measured temperatures with one another;

calculating a first pressure-vessel estimated pressure for the first pressure-vessel from a second pressure-vessel measured temperature of the plurality of pressure-vessel measured temperatures when the first pressure-vessel temperature sensor is malfunctioning; and providing a depressurization alert when a difference between a first pressure-vessel measured pressure and the first pressure-vessel estimated pressure is greater than a threshold, thereby avoiding unscheduled aircraft downtime due to an erroneous or missing temperature measurement in the first pressure-vessel.

8. A fire suppression system of an aircraft comprising:

a first pressure-vessel having a first pressure-vessel pressure transducer;

a second pressure-vessel having a second pressure-vessel temperature sensor;

a controller operationally connected to the first pressure-vessel pressure transducer and the second pressure-vessel temperature sensor, the controller configured to:

receive a first pressure-vessel measured pressure from the first pressure-vessel pressure transducer;

receive a second pressure-vessel measured temperature from the second pressure-vessel temperature sensor;

calculate a first pressure-vessel estimated pressure from the second pressure-vessel measured temperature;

compare the first pressure-vessel estimated pressure with the first pressure-vessel measured pressure; and provide a depressurization alert when a difference between the first pressure-vessel measured pressure and the first pressure-vessel estimated pressure is greater than a threshold, thereby avoiding unscheduled aircraft downtime due to an erroneous or missing temperature measurement in the first pressure-vessel.

9. The system of claim 8, further comprising a first pressure-vessel temperature sensor operationally connected to the controller, and wherein the controller is configured to determining that the first pressure-vessel temperature sensor is malfunctioning before estimating pressure for the first pressure-vessel from the second pressure-vessel measured temperature.

10. The system of claim 9, wherein the controller is further configured to determine that the first pressure-vessel temperature sensor is malfunctioning when the first pressure-vessel temperature sensor is failing to provide a first pressure-vessel measured temperature.

11. The system of claim 10, further comprising a third pressure-vessel with a third pressure-vessel temperature sensor operationally connected to the controller, and wherein the controller is configured to:

receive the first pressure-vessel measured temperature from the first pressure-vessel temperature sensor;

receive a third pressure-vessel measured temperature from the third pressure-vessel temperature sensor;

compare the first pressure-vessel measured temperature, the second pressure-vessel measured temperature and the third pressure-vessel measured temperature and determine therefrom that the first pressure-vessel pressure transducer is malfunctioning.

12. The system of claim 11, wherein the controller further determines that:

a first difference between the first pressure-vessel measured temperature and the second pressure-vessel measured temperature is greater than the threshold; and a second difference between the second pressure-vessel measured temperature and the third pressure-vessel measured temperature is less than the threshold;

thereby determining that that the first pressure-vessel temperature sensor is malfunctioning.

13. The system of claim 12, wherein the controller is further configured to provide a maintenance alert when the first pressure-vessel temperature sensor is malfunctioning.

14. The system of claim 13, wherein the second pressure-vessel further includes a second pressure-vessel pressure transducer operationally connected to the controller and the third pressure-vessel includes a third pressure-vessel pressure transducer operationally connected to the controller.

15. An aircraft including a cargo bay and the fire suppression system of claim 8.

16. The aircraft of claim 15, further comprising:

a discharge head; and a piping system connecting the first pressure-vessel, the second pressure-vessel and the third pressure-vessel with the discharge head.

17. The aircraft of claim 16, wherein each pressure-vessel pressure transducer and each pressure-vessel temperature sensor communicates with the controller over a common databus.

18. The aircraft of claim 16, wherein each pressure-vessel pressure transducer and each pressure-vessel temperature sensor on each pressure-vessel communicates with the controller on one of a respective plurality of databuses.

19. The aircraft of claim 16, wherein the controller is configured to communicate a maintenance alert and the depressurization alert to electronics in a cockpit.

20. The aircraft of claim 19, wherein the controller communicates with the pressure-vessels over a wireless network.

* * * * *